United States Patent [19]

Schweiberer

[11] Patent Number: 4,955,506

[45] Date of Patent: Sep. 11, 1990

[54] DEVICE FOR THE INDIVIDUAL WITHDRAWAL OF SHEET-TYPE PRINTED PRODUCTS, IN PARTICULAR NEWSPAPERS

[76] Inventor: Franz Schweiberer, Klenzestrasse 105, D-8000 Munich 5, Fed. Rep. of Germany

[21] Appl. No.: 346,263

[22] Filed: May 1, 1989

Related U.S. Application Data

[63] Continuation of Ser. No. 168,854, Mar. 16, 1988, abandoned.

[30] Foreign Application Priority Data

Mar. 23, 1987 [DE] Fed. Rep. of Germany ..... 3709506

[51] Int. Cl.[5] ..... B65H 3/22

[52] U.S. Cl. ..... 221/213; 221/218; 221/249; 221/253; 271/18.3

[58] Field of Search ..... 221/213, 217, 218, 249, 221/253, 258; 271/18.3, 117, 34

[56] References Cited

U.S. PATENT DOCUMENTS

| | | | |
|---|---|---|---|
| 1,390,175 | 9/1921 | Stone | 221/213 |
| 1,516,677 | 11/1924 | Markel . | |
| 1,621,960 | 3/1927 | Stewart et al. | 221/213 |
| 2,612,426 | 9/1952 | Hawks . | |
| 2,679,801 | 6/1954 | Ford et al. | 271/117 |
| 2,854,168 | 9/1958 | Abrams et al. | 221/213 |
| 2,876,884 | 3/1959 | Ray | 221/258 |
| 3,216,548 | 11/1965 | Kienel . | |
| 3,463,358 | 8/1969 | Gatti . | |
| 3,885,783 | 5/1975 | Anderson . | |
| 4,139,120 | 2/1979 | Moore | 221/213 |
| 4,258,861 | 3/1981 | Traill et al. | 221/213 |
| 4,296,873 | 10/1981 | Schlumpf | 221/213 |
| 4,319,695 | 3/1982 | Dutro | 271/18.3 |
| 4,367,826 | 1/1983 | Glaser | 221/213 |
| 4,473,172 | 9/1984 | Reynolds | 221/213 |
| 4,508,238 | 4/1985 | Johnson et al. | 221/213 |
| 4,700,869 | 10/1987 | Bogner | 221/241 |
| 4,770,321 | 9/1988 | Anderson | 221/213 |

FOREIGN PATENT DOCUMENTS

| | | |
|---|---|---|
| 68602 | 5/1915 | Fed. Rep. of Germany . |
| 763971 | 12/1956 | United Kingdom . |

OTHER PUBLICATIONS

Caudhill, et al., "Sheet Paper Feed Mechanism", *IBM Technical Disclosure Bulletin,* vol. 14, No. 5, (Oct. 1971), p. 1455.

*Primary Examiner*—H. Grant Skaggs
*Assistant Examiner*—Steve Reiss
*Attorney, Agent, or Firm*—Paul L. Sjoquist

[57] ABSTRACT

A device for individually removing newspapers from an inclined stack, including a movable carriage which is placed over the stack, the carriage having an endless conveyor carrying spaced-apart grippers, the conveyor being connected to drive mechanisms to grip a topmost newspaper and feed it along the incline through a withdrawal slot.

4 Claims, 2 Drawing Sheets

DEVICE FOR THE INDIVIDUAL WITHDRAWAL OF SHEET-TYPE PRINTED PRODUCTS, IN PARTICULAR NEWSPAPERS

This is a continuation of U.S. application Ser. No. 168,854, filed Mar. 16, 1988, and now abandoned.

The invention relates to a device for individual withdrawal of sheet-like printed products, in particular newspapers, comprising a feed means arranged in a housing, gripping the uppermost printed products of a stack and comprising an endless conveyor belt, an endless conveyor chain or the like, having grippers acting intermittently on the printed products on removal of the latter and a withdrawal slot.

Such a device is known from GB-PS 763,971; in this device a bottom plate is provided which raises the newspaper stack to a withdrawal plane, a knurled disc arranged on a link ensuring by rotation the horizontal withdrawal of the uppermost newspaper in the direction towards the side facing the user. In this device there is no guarantee that in each case only the uppermost newspaper alone will be supplied to the withdrawal slot; also, the link arrangement limits the height of the newspaper stack.

The invention is based on the problem of providing a device of the type mentioned at the beginning which by using simple means ensures reliable removal of only the uppermost printed product.

This problem is solved in that according to the invention the endless conveyor belt, the endless conveyor chain or the like carries the grippers or the like, is arranged on a carriage or the like freely lowerable onto the stack and the withdrawal slot is disposed within the housing.

The free movability of the carriage or the like in connectin with the mounting of the grippers on the endless conveyor permits a substantially greater stack height.

Preferably, the removal slot is provided between a guard plate or the like covering the feed or advancing means, a possibly inclined bottom wall and a rear wall of the housing. The grippers may consist of gripper rods arranged transversely of the conveying direction.

Conveniently, the carriage or the like is provided via a linkage with weights or springs beneath the bottom wall. The endless conveyor chain is preferably attached to a plate or the like and connected to the carriage or the like via a pivot rod or the like eXtending perpendicularly to the feed or advancing direction.

According to a modified embodiment the bottom wall is vertically adjustable.

An embodiment is preferred in which the feed means is actuable via a cover closing the housing by a cable, a linkage, a gearing or the like; the gearing may consist of a linkage having an intermittently operating gear/entrainer drive. On the other hand a gear/gear pawl gearing may also be provided.

In the drawings an example of embodiment of the invention is illustrated. It will be described in detail hereinafter. In the drawings.

Figure 1:
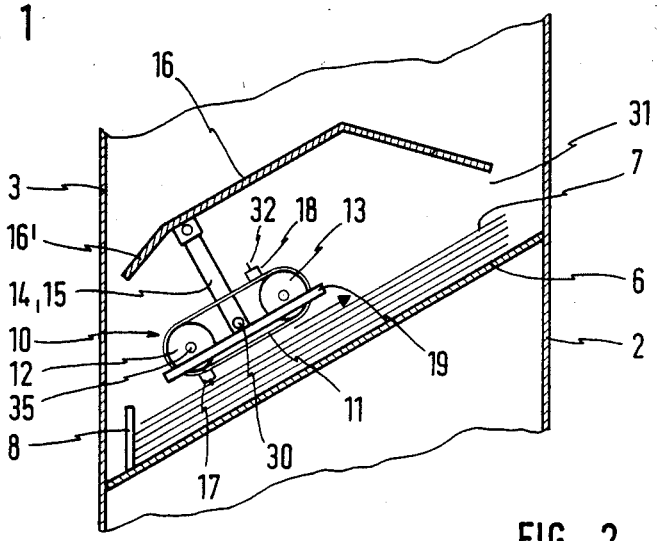
FIG. 1 is a longitudinal section through a part of the housing.

A housing for a semi-automatic withdrawal device for newspapers at a height of about 1–1.20 m consists of upright walls, for example of aluminium, with a pivotal cover or lid 1, a rear wall 2, an end wall 3 and side walls 4 and 5. The housing comprises a rectangular cross-section with a width of about 50 cm and a depth of about 40 cm.

Provided in the housing is a bottom plate 6 with an inclination from the rear wall 2 to the front wall 3 and carrying a stack 7 of newspapers. The inclination of the bottom plate 6 may be at an angle of 15°–35°; this inclination ensures that the newspaper stack 7 bears against the endside engagement plate 8.

Provided above the newspaper stack 7 is a feed means, generally designated by 10, which consists substantially of an endless conveyor chain 11 having gears 12 and 13, holders 14, 15, a guard plate 16 and grippers 17, 18. The two gears 12 and 13 are mounted on a plate 19. The entire feed means forms a carriage movable up and down in the housing.

Figure 2:
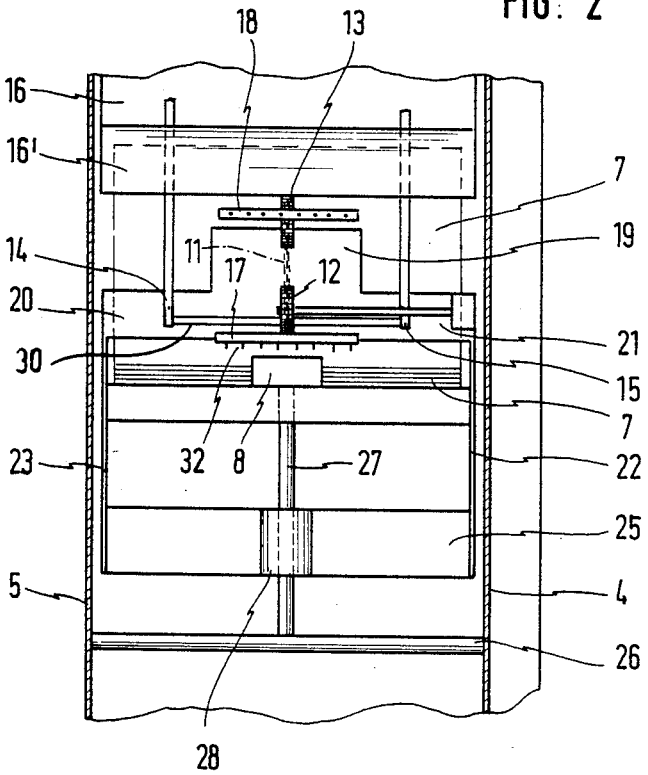
FIG. 2 is a longitudinal section through the housing perpendicular to the section of FIG. 1.
Figure 3:
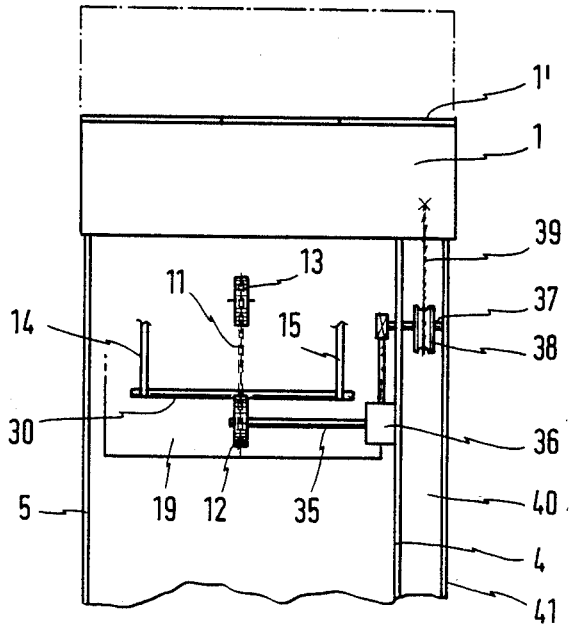
FIG. 3 is a section in the same direction as FIG. 2 but with some parts omitted and FIG. 4 is a detail.
Figure 4:
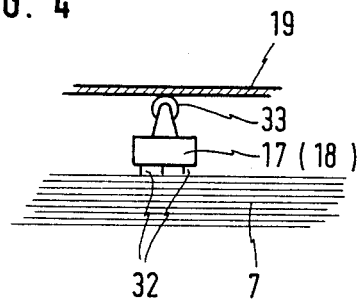

As apparent from FIG. 2 the plate 19 extends with its wings 20 and 21 up to the vicinity of the side walls 4, 5, and at the sides of the guard plate 16 respective rods 22 and 23 are attached which are connected at their lower ends by a crossmember 25. A circular vertical guide rod 27 is attached to a rod 26 connecting the side walls 4 and 5. The crossmember 25 comprises a cylindrical ring 28 having a central opening adapted to the guide rod 27.

The carriage with its feed means can thus slide up and down on the guide rod 27.

The springs and weights with which the carriage is balanced so that it rests with relatively force on the newspaper stack 7 are not illustrated.

The plate 19, having corresponding holes for the conveyor chain 11, is connected via a link rod 30 and the holders 14, 15 to the guard plate 16; the latter has an inclined front edge 16'.

The conveyor chain 11 with the two gripper rods 17, 18 described in detail below is thus pivotal about the pivot rod 30 so that the grippers and the chain 11 can adapt themselves to the particular surface of the stack.

The uppermost newspaper gripped by advance of the grip rod 17 or 18 after actuation of the release mechanism is moved in the direction towards the rear wall 2 (direction of the arrow) so that after completion of the feed movement the rear edge of the uppermost newspaper can be gripped above the slot 31 to enable the operator to withdraw the newspaper.

The gripper rods 17 and 18, which may have a length of 15 cm, are fixedly attached to the conveyor chain 11 and have needles or pins 32 with which the uppermost newspaper is gripped. On the opposite side the gripper rods 17 and 18 are provided with rollers 33 which roll on the lower side of the plate 19 and thus provide the gripper rods 17, 18 with a resilient guiding during the withdrawal movement; due to the mounting in the pivot rod 30 the plate 19 can adapt itself to irregularities in the newspaper stack.

The drive of the conveyor chain is via the gear 12 which carries a shaft 35 leading to a gearing 36. Said gearing is connected via a shaft 37 to a pulley 38 having a cable 39 secured to the cover 1 pivotal about the hinge 1'.

On opening of the cover 1 and thus initiation of the feed movement of the conveyor chain 11 the gripping rod 17 grips the uppermost newspaper of the stack 7 and pushes it (in the direction of the arrow) towards the rear wall 2. The guide rod 17 resilients guides the newspaper in the parallel section of the conveyor chain 11. However, by the advancing initiated the conveyor chain 11 is moved a further half revolution of the gear 12 or 13 so that after conclusion of the feed movement the gripper rod 18 comes into contact with the surface of the next newspaper.

In the next raising of the cover 1 the gripping rod 18 then effects the feed movement just mentioned.

The pulley 38 is accommodated in a chamber 40 which is provided laterally of the side wall and is closed by a side wall 41 extending parallel to the wall 4.

For coin-actuated removal of a newspaper a coin insert point with catch can be provided which releases the cover only after insertion of the correct coin.

It is however also possible to couple the coin actuation to the pulley 38 or the cable 39 so that the cover can be opened as desired without the feed means being actuated but after insertion of a coin a coupling is effected between the cable 38 and the gearing of the feed means so that the coin insertion releases the feed means.

The aforementioned conveyor chain may be constructed as endless link chain running slip-free over two gears.

Instead of actuation of the feed or advancing means (possibly after inserting a coin) by raising the cover it is also possible to attach laterally of the housing a long tilt lever which can be operated by hand and operates the feed means by pivoting.

I claim:

1. A device for the individual withdrawal of sheet-like printed products, such as newspapers, arranged in an inclined stack in a housing, comprising a carriage assembly movably positionable above said stack, said carriage assembly having a pair of aligned, spaced-apart gears pivotally mounted thereto; an endless conveyor connected about said gears, said conveyor having spaced-apart gripper rods affixed thereto; means for rotating said gears and thereby moving said conveyor and said gripper rods along said inclined stack; said gripper rods being affixed to said endless conveyor transverse to the direction of movement of said conveyor, each of said gripper rods having a plurality of gripper fingers; a guard plate supported above said carriage assembly in said housing and having substantially identical dimensions as the sheets to be withdrawn, and for covering said stack; and a withdrawal slot in said housing proximate the upper end of said inclined stack, formed between said guard plate and said housing, to receive products therethrough.

2. The device of claim 1, further comprising a hinged cover over said housing.

3. The device of claim 2, further comprising means, connected between said cover and said means for rotating said gears, for activating said means for rotating said gears upon opening said cover.

4. The device of claim 3, wherein said means for activating is intermittently operated when said cover is opened.

* * * * *